US006700490B2

(12) United States Patent
Frederick

(10) Patent No.: US 6,700,490 B2
(45) Date of Patent: Mar. 2, 2004

(54) DIGITAL DETECTION FILTERS FOR ELECTRONIC ARTICLE SURVEILLANCE

(75) Inventor: Thomas J. Frederick, Coconut Creek, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 180 days.

(21) Appl. No.: 10/104,829

(22) Filed: Mar. 22, 2002

(65) Prior Publication Data

US 2002/0135482 A1 Sep. 26, 2002

Related U.S. Application Data

(60) Provisional application No. 60/278,805, filed on Mar. 26, 2001.

(51) Int. Cl.[7] ..... G08B 13/14

(52) U.S. Cl. ..... 340/572.4; 340/10.1; 375/343; 708/314; 708/422

(58) Field of Search ..... 340/572.4, 572.1, 340/10.1, 10.3, 10.4; 342/42; 708/422, 314; 375/261, 340, 343, 350; 455/130; 702/66

(56) References Cited

U.S. PATENT DOCUMENTS

| | | | | | |
|---|---|---|---|---|---|
| 4,010,465 | A | | 3/1977 | Dodington et al. | 342/35 |
| 4,112,497 | A | * | 9/1978 | Layland et al. | 708/422 |
| 4,164,036 | A | * | 8/1979 | Wax | 702/74 |
| 4,622,543 | A | | 11/1986 | Anderson et al. | 340/572.1 |
| 4,700,179 | A | | 10/1987 | Fancher | 340/572.2 |
| 4,703,462 | A | * | 10/1987 | Woodsum | 367/92 |
| 4,875,050 | A | * | 10/1989 | Rathi | 342/195 |
| 5,089,822 | A | * | 2/1992 | Abaunza et al. | 342/30 |
| 5,276,430 | A | | 1/1994 | Granovsky | 340/572.4 |
| 5,317,318 | A | * | 5/1994 | Thomas et al. | 342/44 |
| 5,463,376 | A | | 10/1995 | Stoffer | 340/572.4 |
| 5,471,509 | A | * | 11/1995 | Wood et al. | 375/350 |
| 5,519,381 | A | | 5/1996 | Marsh et al. | 340/10.2 |
| 5,526,357 | A | * | 6/1996 | Jandrell | 370/346 |
| 5,764,686 | A | * | 6/1998 | Sanderford et al. | 375/149 |
| 5,805,105 | A | * | 9/1998 | Coveley | 342/125 |
| 5,896,060 | A | * | 4/1999 | Ovard et al. | 329/304 |
| 5,923,251 | A | | 7/1999 | Raimbault et al. | 340/572.1 |
| 5,952,922 | A | | 9/1999 | Shober | 340/572.4 |
| 6,020,856 | A | | 2/2000 | Alicot | 343/742 |
| 6,107,910 | A | * | 8/2000 | Nysen | 340/10.1 |
| 6,118,378 | A | | 9/2000 | Balch et al. | 340/572.7 |
| 6,122,329 | A | | 9/2000 | Zai et al. | 375/329 |
| 6,169,474 | B1 | | 1/2001 | Greeff et al. | 340/10.1 |
| 6,172,608 | B1 | | 1/2001 | Cole | 340/572.1 |
| 6,232,878 | B1 | * | 5/2001 | Rubin | 340/572.1 |
| 6,483,427 | B1 | * | 11/2002 | Werb | 340/10.1 |
| 6,504,867 | B1 | * | 1/2003 | Efstathiou | 375/227 |

* cited by examiner

*Primary Examiner*—Benjamin C. Lee

(57) ABSTRACT

Digital implementation of electronic article surveillance (EAS) detection filtering for pulsed EAS systems is provided. Embodiments include direct implementation as a quadrature matched filter bank, as an envelope detector, a correlation receiver, and as a discrete Fourier transform. Pre-detection nonlinear filtering is also provided for impulsive noise environments.

22 Claims, 13 Drawing Sheets

DIGITAL DETECTION FILTERS FOR ELECTRONIC ARTICLE SURVEILLANCE

CROSS REFERENCES TO RELATED APPLICATIONS

This application claims the benefit of U.S. Provisional Application No. 60/278,805, filed Mar. 26, 2001.

STATEMENT REGARDING FEDERALLY SPONSORED RESEARCH OR DEVELOPMENT

Not Applicable

BACKGROUND OF THE INVENTION

1. Field of the Invention

This application relates to digital implementation of electronic article surveillance (EAS) detection filtering, and more particularly to detection filtering in pulsed EAS systems.

2. Description of the Related Art

EAS systems, such as disclosed in U.S. Pat. Nos. 4,622,543, and 6,118,378 transmit an electromagnetic signal into an interrogation zone. EAS tags in the interrogation zone respond to the transmitted signal with a response signal that is detected by a corresponding EAS receiver. Previous pulsed EAS systems, such as ULTRA*MAX sold by Sensormatic Electronics Corporation, use analog electronics in the receiver to implement detection filters with either a quadrature demodulation to baseband or an envelope detection from an intermediate frequency conversion. The EAS tag response is a narrow band signal, in the region of 58000 hertz, for example.

An EAS tag behaves as a second order resonant filter with response $$s(t)=A\cdot e^{-\alpha\cdot t}\cdot\sin(2\cdot\pi\cdot f_0\cdot t+\theta),$$

where A is the amplitude of the tag response, $f_0$ is the natural frequency of the tag, and $\alpha$ is the exponential damping coefficient of the tag. The natural frequency of the tag is determined by a number of factors, including the length of the resonator and orientation of the tag in the interrogation field, and the like. Given the population of tags and possible trajectories through the interrogation zone, the natural frequency is a random variable. The probability distribution of the natural frequency has a bell shaped curve somewhat similar to Gaussian. For simplifying the receiver design it may be assumed uniform without a great loss in performance. Its distribution is assumed to be bounded between some minimum and maximum frequencies, $f_{min}$ and $f_{max}$, respectively.

The exponential damping coefficient $\alpha$, in effect, sets the bandwidth of the tag signal. Nominal values for $\alpha$ are around 600 with magnetomechanical or acousto-magnetic type tags. On the other hand, for ferrite tags cc will be much larger, on the order of 1200 to 1500.

The phase of the tag response depends on the transmit signal and many of the same parameters as the natural frequency. The transmit signal determines the initial conditions on the tag when the transmitter turns off. This sets the phase of the response as it goes through its natural response. The amplitude of the tag's response is dependent on all of the same parameters: orientation and position in the field, physics of the tag, etc.

Pulse EAS systems, such as ULTRA*MAX systems, operating around 60000 Hz preside in a low frequency atmospheric noise environment. The statistical characteristic of atmospheric noise in this region is close to Gaussian, but somewhat more impulsive, e.g., a symmetric $\alpha$-stable distribution with characteristic exponent near, but less than, 2.0. In addition to atmospheric noise, the 60000 hertz spectrum is filled with man made noise sources in a typical office/retail environment. These man made sources are predominantly narrow band, and almost always very non-Gaussian. When many of these sources are combined with no single dominant source, the sum approaches a normal distribution due to the Central Limit Theorem. The classical assumption of detection in additive white Gaussian noise is used herein. The "white" portion of this assumption is reasonable since the receiver input bandwidth of 3000 to 5000 hertz is much larger than the signal bandwidth. The Gaussian assumption is justified as follows.

Where atmospheric noise dominates the distribution is known to be close to Gaussian. Likewise, where there are a large number of independent interference sources the distribution is close to Gaussian due to the Central Limit Theorem. If the impulsiveness of the low frequency atmospheric noise were taken into account, then the locally optimum detector could be shown to be a matched filter preceded by a memoryless nonlinearity (for the small signal case). The optimum nonlinearity can be derived using the concept of "influence functions". Although this is generally very untractable, there are several simple nonlinearities that come close to it in performance. To design a robust detector some form of nonlinearity must be included.

When there is a small number of dominant noise sources we include other filtering, prior to the detection filters, to deal with these sources. For example, narrow band jamming is removed by notch filters or a reference based LMS canceller. After these noise sources have been filtered out, the remaining noise is close to Gaussian.

Referring to FIG. 1, when the signal of interest is completely known a matched filter is the optimum detector. In our case, say we knew the resonant frequency of the tag and its precise phase angle when ringing down. The signal we're trying to detect is $$s(t)=A\cdot e^{-\alpha\cdot t}\cdot\sin(2\cdot\pi\cdot f_0\cdot t+\theta).$$

Then the matched filter is simply the time reversed (and delayed for causality) signal, $s(T_r-t)$ at 2. The matched filter output is sampled at 4 at the end of the receive window, $T_r$, and compared to the threshold at 6. A decision signal can be sent depending on the results of the comparison to the threshold. The decision can be a signal to sound an alarm or to take some other action. Note that we do not have to know the amplitude, A. This is because the matched filter is a "uniformly most powerful test" with regard to this parameter. This comment applies to all the variations of matched filters discussed below.

Referring to FIG. 2, when the signal of interest is completely known except for its phase $\theta$, then the optimum detector is the quadrature matched filter (QMF). QMF is also known as noncoherent detection, since the receiver is not phase coherent with the received signal. On the other hand, the matched filter is a coherent detector, since the phase of the receiver is coherent with the received signal. The receive signal r(t) which includes noise and the desired signal s(t) is filtered by $s(T_r-t)$ at 8 as in the matched filter, and again slightly shifted in phase by $\pi/2$ at 10. The outputs of 8 and 10 are each squared at 12, combined at 14, sampled at 16, and compared to the threshold at 18.

Referring to FIG. 3, when the signal of interest is completely known except for its frequency $f_n$ and phase $\theta$, then the optimum detector is a bank of quadrature matched filters (QMFB). A quadrature matched filter bank can be implemented as a plurality of quadrature matched filters 20, 22, 24, and 26, which correlate to quadrature matched filters with center frequencies of $f_1$, $f_2$ through $f_n$, respectively. The outputs of the quadrature matched filters are summed at 28, sampled at 29 and compared to a threshold at 30.

Referring to FIG. 4 a block diagram of a conventional analog EAS receiver is illustrated. The antenna signal 32 passes through a gain and filtering stage 34 with center frequency equal to the nominal tag frequency and bandwidth of about 3000 hertz, for example. Following this, the signal is demodulated to baseband with a quadrature local receive oscillator 36. The oscillator frequency may or may not be matched precisely to the transmit frequency. Furthermore, the oscillator phase is not necessarily locked to the transmit oscillator's phase.

The in-phase (I) and quadrature-phase (Q) baseband components are subsequently lowpass filtered by the in-phase 38 and quadrature-phase 40 baseband filters, respectively. This serves to remove the double frequency components produced by the mixing process, as well as further reduces the detection bandwidth. These baseband filters are typically $4^{th}$ order analog filters, e.g., Butterworth and Chebychev type.

The outputs of the baseband filters 38, and 40 are passed through rectifiers 42 and 44, respectively, which removes the sign information from the I and Q components. The outputs of the rectifiers, are sampled by ADC 46 and 48, respectively, at the end of the receive window and passed into the microprocessor, where the I and Q components are squared and summed together to produce a noncoherent detection statistic.

Referring to FIG. 5, a block diagram of an alternate analog EAS receiver is illustrated. The antenna signal 50 passes through a gain and filtering stage 52 with center frequency equal to the nominal tag frequency and bandwidth of about 5000 hertz, for example. Following this, the signal is modulated to an intermediate frequency (IF) of approximately 10000 hertz with a local receive oscillator at 52. The IF signal is filtered by an IF bandpass filter 54 with bandwidth of approximately 3000 hertz to remove off frequency products from the mixer and further reduce bandwidth for the detector.

The filtered IF signal then passes through an envelope detector, which in this case is the combination of a rectifier 55 and lowpass filter 56. The output of the envelope detector is sampled by an ADC 58 and passed to the processor for detection processing. Note that envelope detection removes the phase of the receive signal. In fact, it can be shown that envelope detection is simply a different implementation of a quadrature detector, and thus it is noncoherent.

The problem presented was to design a cost-effective system, which would more reliably detect a tag response in the presence of noise. The noise environment is assumed to be close to Gaussian with much wider bandwidth than the tag signal. Some environments may include narrow band interference from electronic equipment.

BRIEF SUMMARY OF THE INVENTION

The present invention provides, in a first aspect, a system and method, using a quadrature matched filter bank, to digitally detect a signal from an electronic article surveillance tag. The system and method including: filtering using a detection filter pair comprised of $h(T_0-t)\cdot\sin(\omega\cdot t)$ and $h(T_0-t)\cdot\cos(\omega\cdot t)$, where the envelope $h(T_0-t)$ contains preselected time and frequency domain properties according to the signal to be detected; squaring the output of each of the filters; summing the squared outputs of each of the filter pairs to provide a test statistic for detection of the tag signal.

The system and method further including a plurality of the filter pairs wherein each pair is at a frequency $\omega_n$ for $1 \leqq n \leqq N$, where N is selected to cover the range of uncertainty of the signal to be detected, and summing each of the squared and summed results of each of the filter pairs to provide the test statistic for detection of the tag signal. Each of the filter pairs can be matched to the response signal from the electronic article surveillance tag wherein the envelope $h(T_0-t)$ is the time reversed version of the signal to be detected.

In a second aspect, a system and method, using a quadrature matched filter bank with envelope estimation, for detecting the signal from an electronic article surveillance tag. The system and method including: filtering using a filter comprised of $h(T_0-t)\cdot\sin(\omega_n\cdot t)$ wherein the envelope $h(T_0-t)$ contains preselected time and frequency domain properties according to the signal to be detected; envelope detecting of the output of the filter; and, squaring the output of the envelope detection to provide a test statistic for detection of the tag signal.

The system and method further including a plurality of the filters wherein each filter is at a frequency $\omega_n$ for $1 \leqq n \leqq N$, where N is selected to cover the range of uncertainty of the signal to be detected; and, then summing the squared output of the plurality of filters to provide the test statistic for detection of the tag signal. Each of the filters can be matched to the response signal from the electronic article surveillance tag wherein the envelope $h(T_0-t)$ is the time reversed version of the signal to be detected.

In a third aspect, a system and method, using a bank of correlation receivers, for detecting a signal from an electronic article surveillance tag. The system and method including: a correlation receiver that mixes a received signal with an envelope h(t) and a pair of local oscillators $\cos(\omega\cdot t)$ and $\sin(\omega\cdot t)$; integrating the mixed signal over the sampling period $T_0$; squaring the integrated output; summing the squared output for each of the pair of local oscillators to provide a test statistic for detection of the tag signal.

The system and method further including a plurality of the correlation receivers where the local oscillators $\cos(\omega_n\cdot t)$ and $\sin(\omega_n\cdot t)$ are at frequency $\omega_n$ for $1<n<N$, where N is selected to cover the range of uncertainty of the signal to be detected; and, summing the output of the plurality of correlation receivers to provide the test statistic for detection of the tag signal.

In a fourth aspect, the system and method of the third aspect where the local oscillators and the integration comprise a discrete Fourier transform Objectives, advantages, and applications of the present invention will be made apparent by the following detailed description of embodiments of the invention.

DETAILED DESCRIPTION OF THE INVENTION

Figure 1:
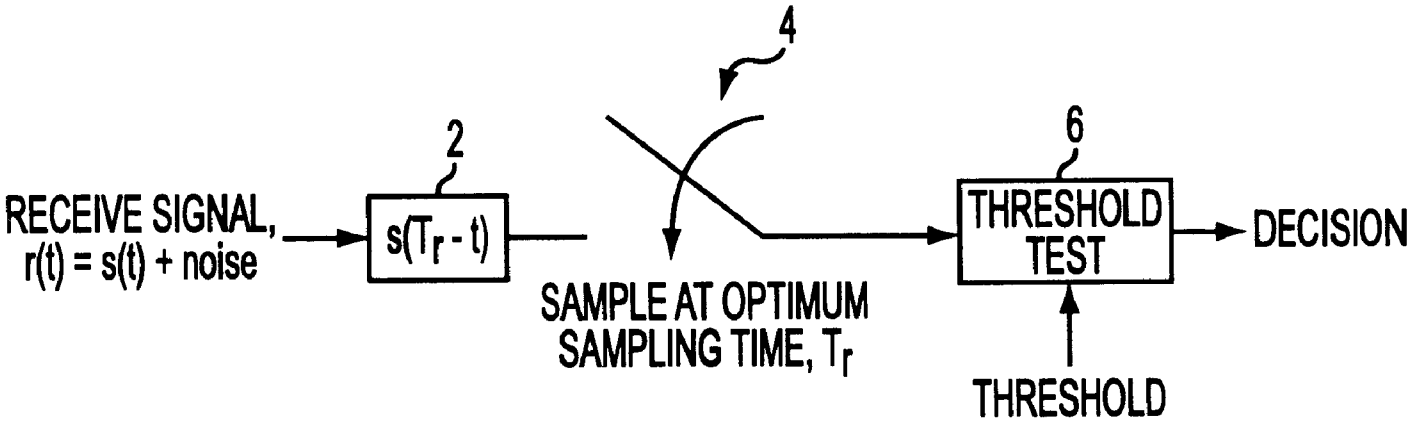
FIG. 1 (PRIOR ART)
FIG. 1 is a block diagram of a conventional matched filter detector.
Figure 2:
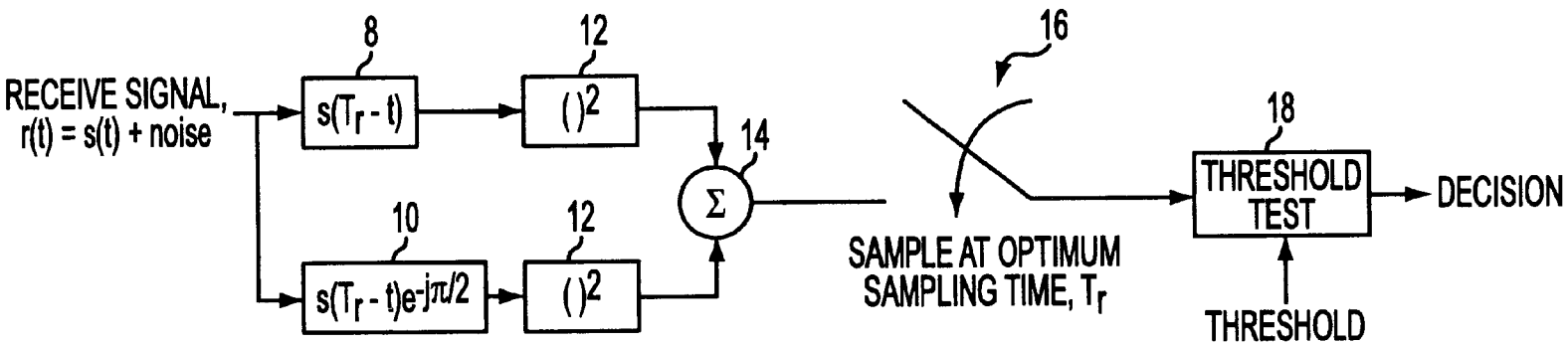
FIG. 2 (PRIOR ART)
FIG. 2 is a block diagram of a conventional quadrature matched filter detector.
Figure 3:
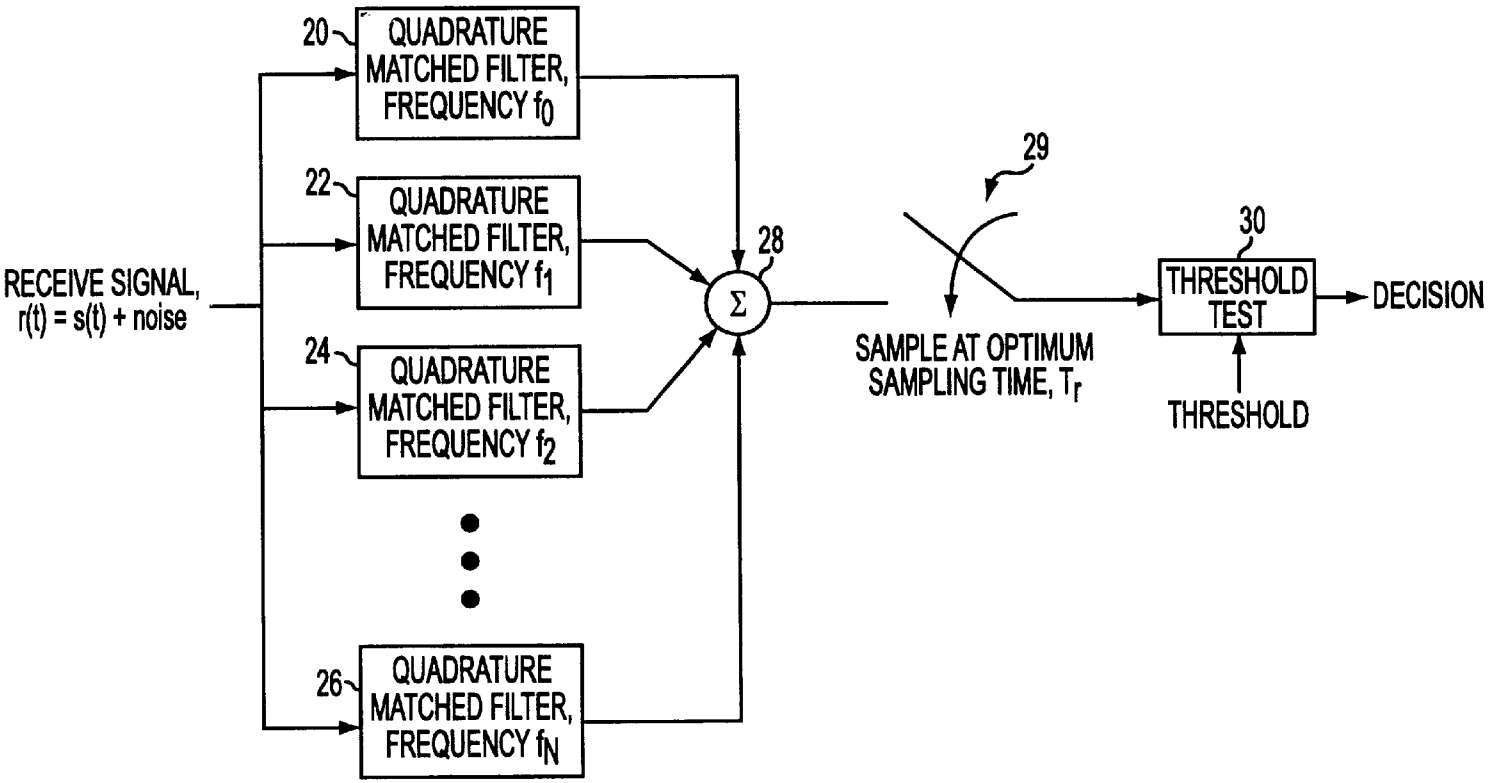
FIG. 3 (PRIOR ART)
FIG. 3 is a block diagram of a conventional implementation of a bank of the quadrature matched filters shown in FIG. 2.
Figure 4:
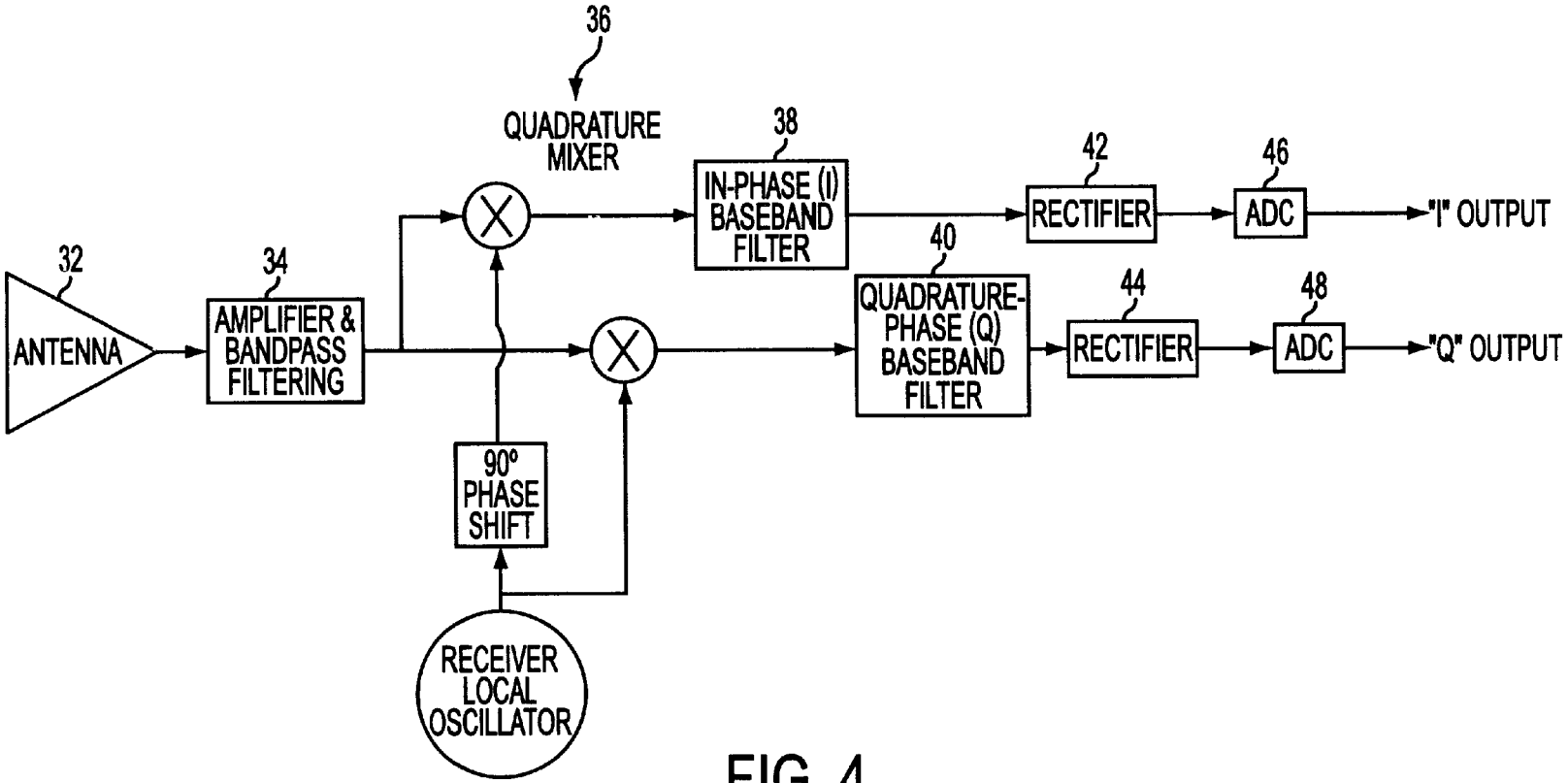
FIG. 4 (PRIOR ART)
FIG. 4 is a block diagram of a conventional analog EAS receiver.
Figure 5:
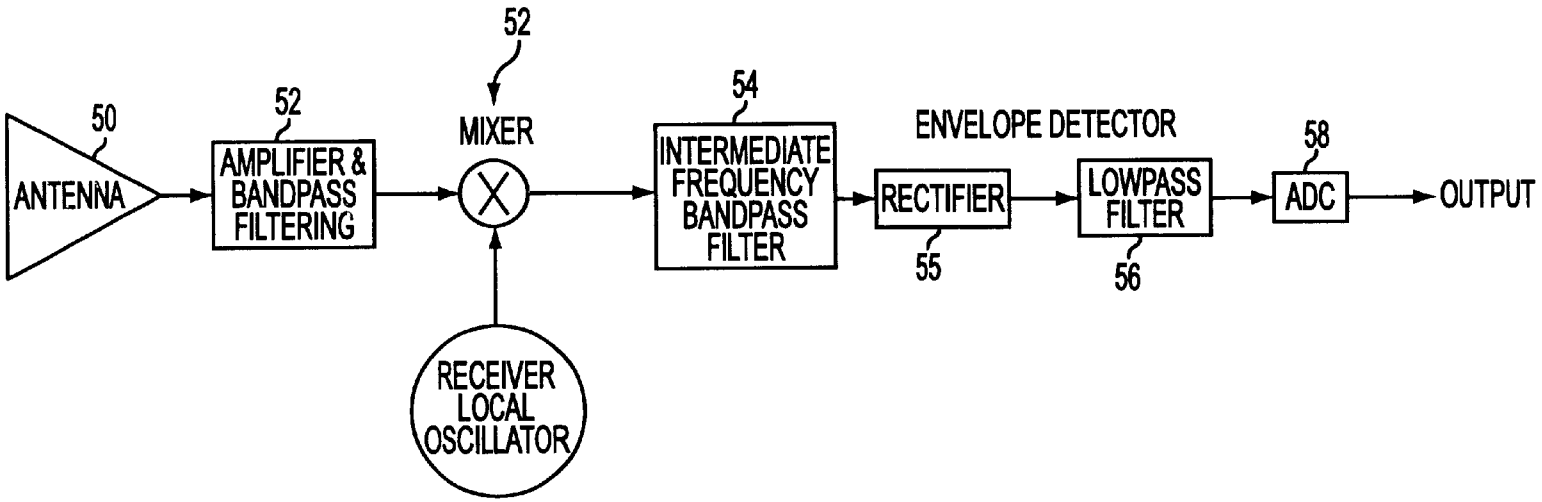
FIG. 5 (PRIOR ART)
FIG. 5 is a block diagram of an alternate conventional analog EAS receiver.

The following describe the basic implementation of various components needed for implementing an EAS receiver in digital hardware or software. Local oscillators are a fundamental part of most receiver architectures. There are several ways to implement them digitally. When the sampling rate is a multiple of the oscillator frequency one can directly store a sampled version of one period, then repeatedly read from the table to generate a continuous oscillator signal. If the sampling frequency is not a multiple of the oscillator frequency, the frequency needs to be programmable, or multiple frequencies are needed, then there are two common approaches. One is to store a much finer sampling of the oscillator sinusoid, then use a variable phase step size through the table to change the frequency. If very fine frequency resolution is required the sinusoid table can become too large. In this case, the common trigonometric identities $\cos(A+B)=\cos(A)\cos(B)-\sin(A)\sin(B)$ and $\sin(A+B)=\sin(A)\cos(B)+\cos(A)\sin(B)$ may be used to generate a much finer phase step using two tables: a coarse sinusoid table and a fine sinusoid table. Other variations on these schemes are possible, but the basic ideas are the same.

Signal modulators are, in the simplest case, simple multipliers that multiply two signals together. This is often a difficult thing to accomplish in analog hardware, so shortcuts are used, such as chopper modulators, etc. However, in a digital implementation it is possible to directly implement the signal multiplication.

Digital implementations of linear filters are divided into two broad classes: finite impulse response filters, and infinite impulse response filters. In analog circuitry it is usually only possible to implement infinite impulse response filters, with the exception of specialized devises such as surface acoustic wave (SAW) filters, which at 58 kHz would be truly enormous.

In general, finite impulse response (FIR) filters can be implemented using only the input signal and delayed versions of the input signal. There is a wide range of references available for designing/implementing FIR filters and one skilled in the art can do so.

Infinite impulse response (IIR) filters must use, in addition to the input signal, copies of the output signal or internal state variables to be implemented. Again, there is a wide range of references available for designing/implementing IIR filters and one skilled in the art can do so.

A common noncoherent receiver implementation will use envelope detection. This can be accomplished using Hilbert transform algorithms implemented digitally. This gives a precise estimate of the waveform envelope. By designing a Hilbert transform FIR filter it is possible to get frequency selectivity together with envelope estimation. Another approach that is a coarser approximation, particularly useful for narrow band signals, is to choose the sampling rate so that a 90 degree phase shift (at the center frequency) is approximately an integer number of samples. Then the quadrature signals are simply an integer number of samples shift.

The following describe the disclosed invention including various embodiments for digital implementation of detection filters for pulsed EAS systems. The embodiments show implementations for the frequency conversion and for the detection filters. A fundamental assumption to all of the following is that the receive signal has been sampled by an analog-to-digital converter (ADC). Thus, all of the processing takes place in the sampled time "digital" domain as opposed to continuous time analog domain. One exception to this discussed below is where the concept of sub-sampling of the signal is disclosed, in which case the ADC sampling actually is the frequency conversion.

Figure 6:
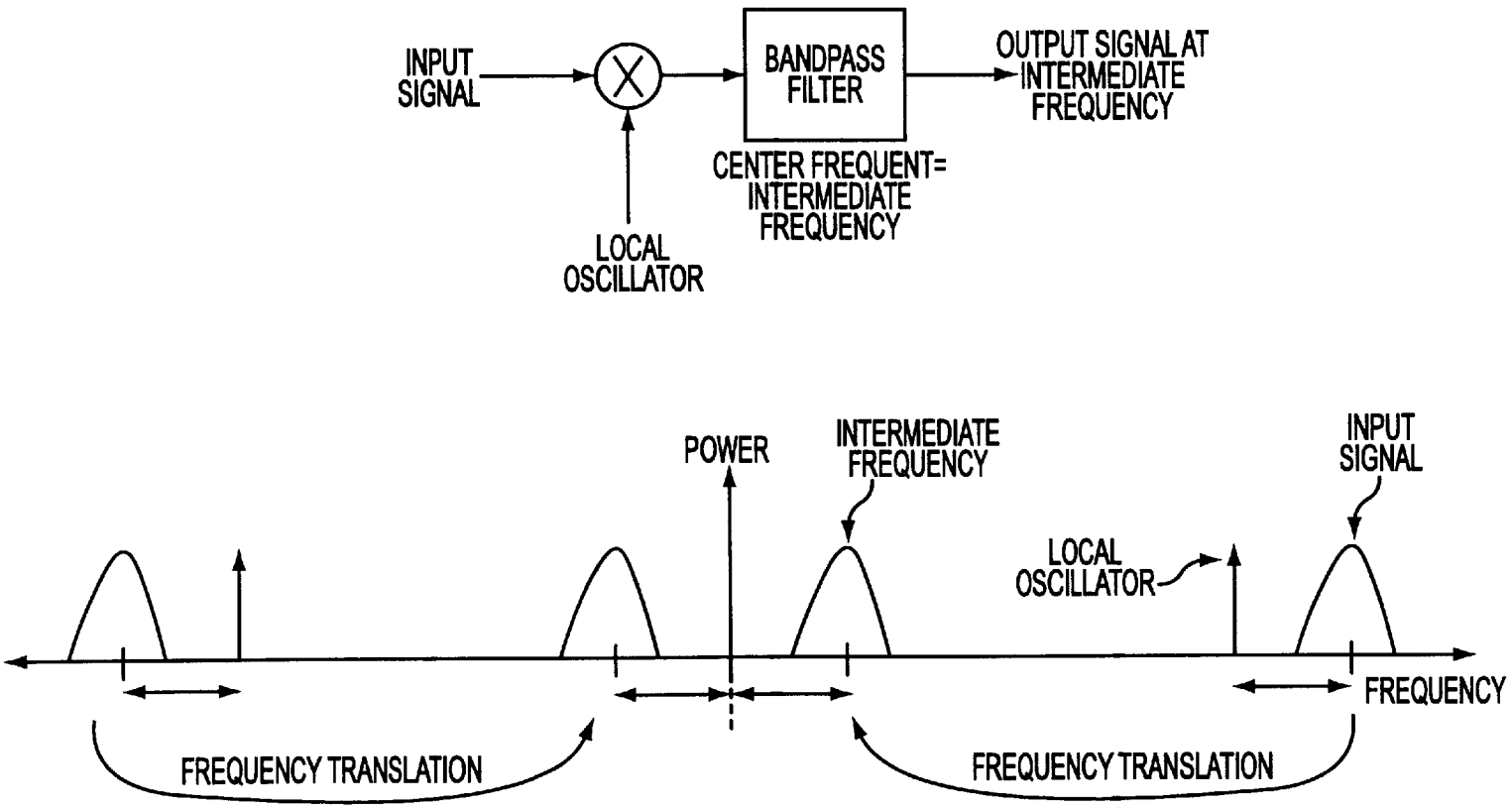
FIG. 6 is a block diagram showing frequency conversion for non-overlapping intermediate frequencies for the present invention.
Figure 7:
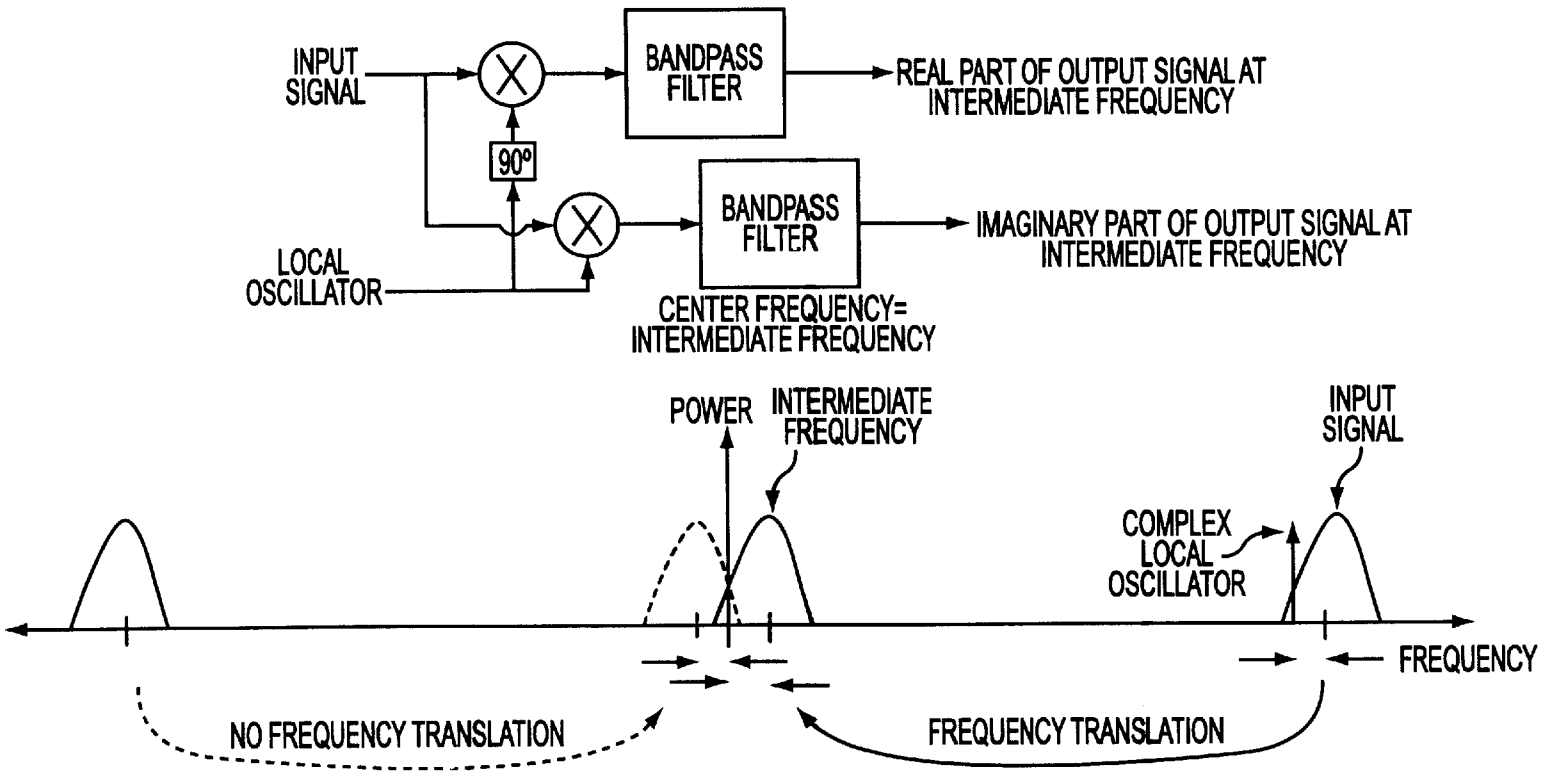
FIG. 7 is a block diagram showing frequency conversion for overlapping intermediate frequencies for the present invention.

Referring to FIGS. 6 and 7, frequency conversion will typically be used to translate the receive signal lower in frequency to ease some other aspect of processing, typically memory or computational consumption. This is because as the center frequency of the signal is reduced, the sampling frequency can also be reduced. Two situations are possible: non-overlapping intermediate frequencies or overlapping intermediate frequencies.

FIG. 6 shows an example in which the output intermediate frequencies do not overlap. In this case, the receive local oscillator can be real valued and the output can be real valued.

FIG. 7 shows an example in which the output intermediate frequencies do overlap. In this case, the receive local oscillator must be complex valued and the output will be complex valued.

Figure 8:
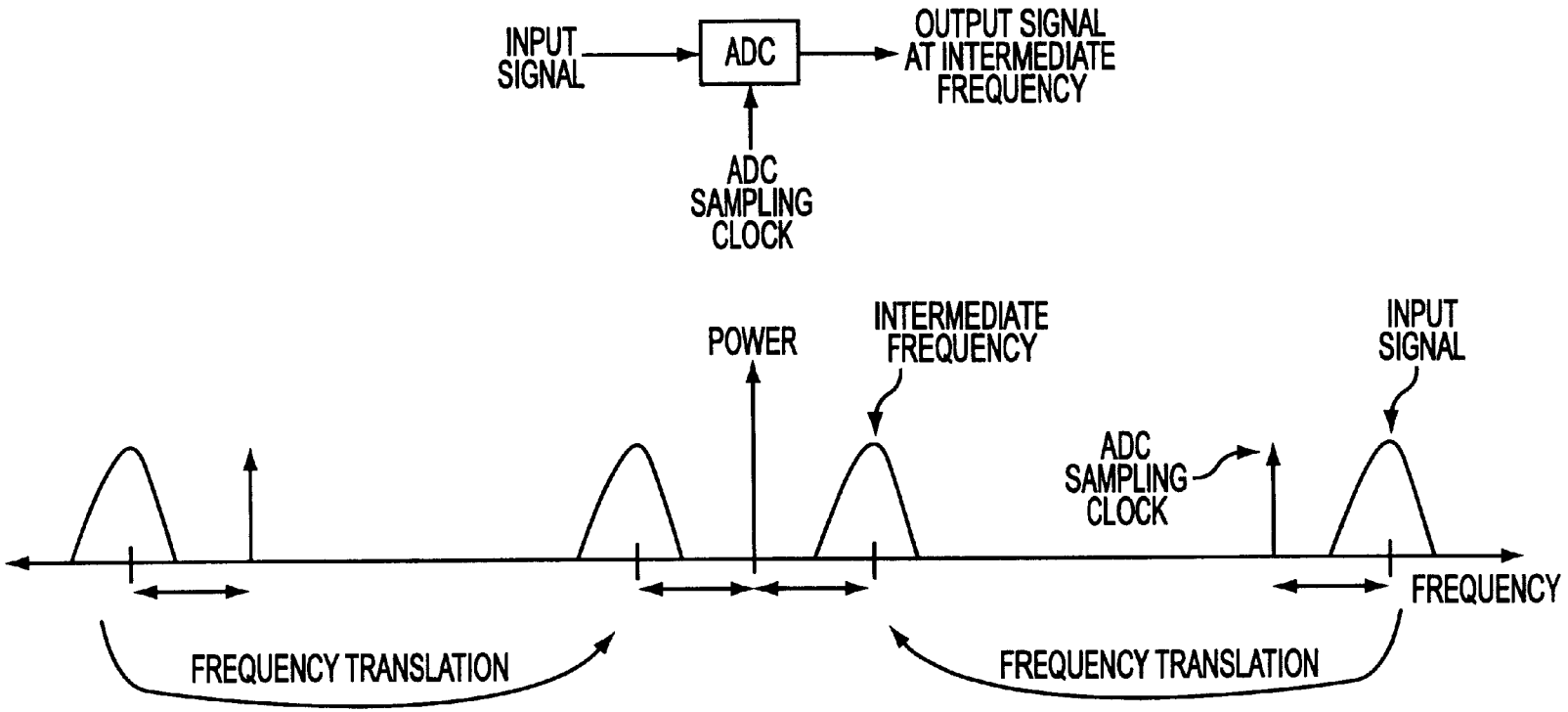
FIG. 8 is a block diagram showing frequency conversion and translation using an ADC for non-overlapping intermediate frequencies for the present invention.

Referring to FIG. 8, if little or no signal intermediate frequency overlap occurs an ADC can be used to simultaneously sample and down convert the data. Aliasing distortion is possible if a significant amount of noise occurs at the image frequency. In addition, the lower sampling rates may be less effective for filtering impulsive noise.

The following describes digital implementation of the optimum detector as a quadrature matched filter bank (QMFB). The implementations are independent of the frequency of operation, i.e., directly at passband, at an intermediate frequency, or at baseband. Only the frequencies of the local oscillators change. Note that the combining of the QMF's is shown as uniform summation, which is appropriate for a uniform probability distribution of the natural frequencies. If a non-uniform distribution is assumed, then the outputs of the QMF's must be weighted appropriately. Also, the difference between $\alpha$ in ferrite tags and regular magnetomechanical EAS tags must be accounted for. This can be accomplished by one of three approaches: manual selection of the matched envelope function, calculating the QMFB with both envelope functions and selecting the output with the highest (normalized) energy, or choosing one envelope function as a suboptimum compromise for both types of tag environments.

Figure 9:
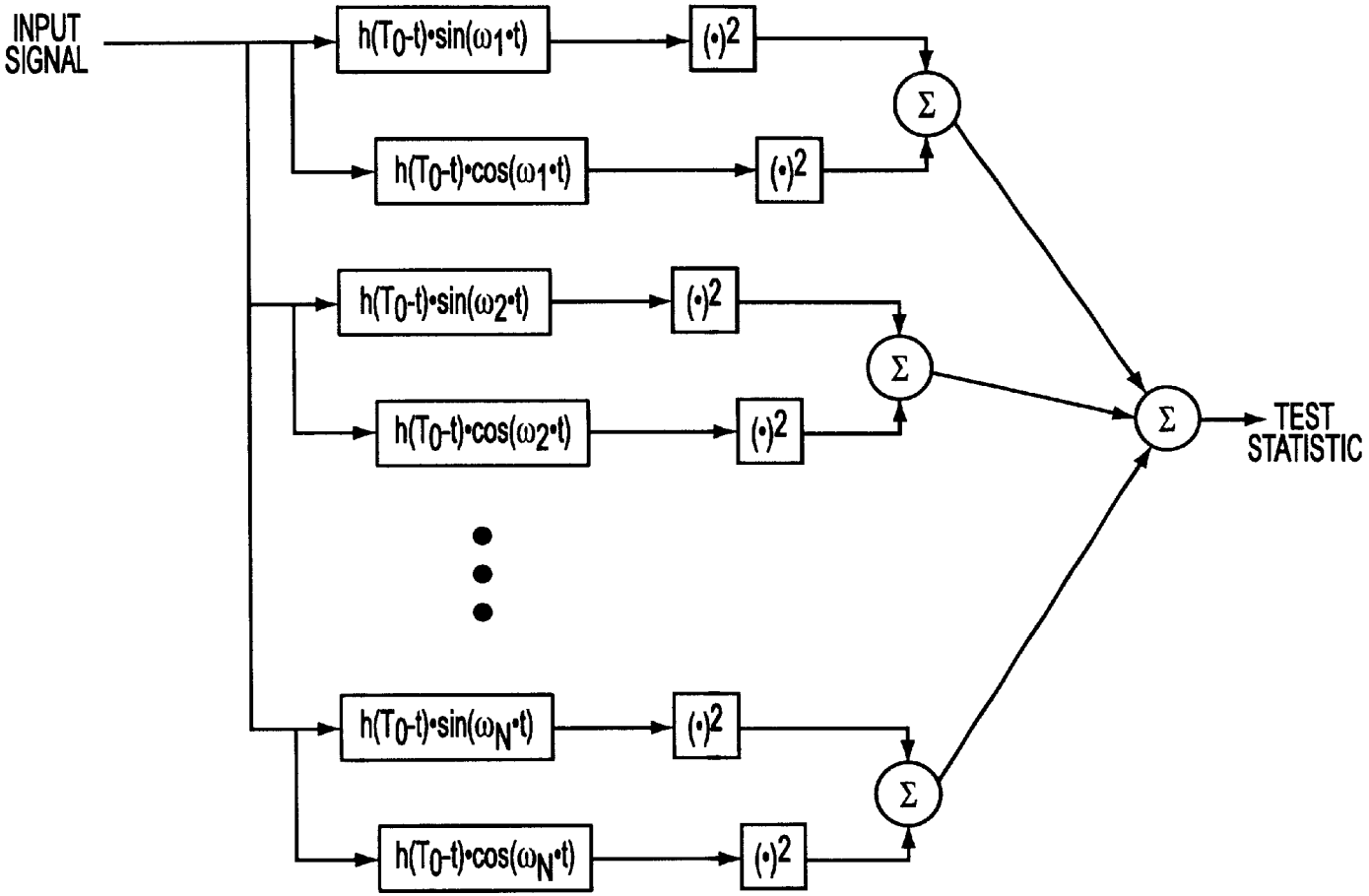
FIG. 9 is a block diagram showing one embodiment for direct implementation of the quadrature matched filter bank of the present invention.

Referring to FIG. 9, a direct implementation of the QMFB is illustrated. The matched filters "$h(T_0-t)\cdot\sin(\omega_n\cdot t)$" and "$h(T_0-t)\cdot\cos(\omega_n\cdot t)$" are in phase quadrature to one another. The envelope "$h(T_0-t)$" is the time reversed version of the nominal envelope of the signal to be detected. The time $T_0$ is the sampling time at the output of the detection filters. The frequencies $\omega_n$ for $1\leqq n\leqq N$ are chosen to cover the range of uncertainty of the tag signal. In practice the window function "$h(T_0-t)$" may be chosen based on a number of criteria and constraints, including spectral resolution, minimizing energy due to transmitter ringdown, or simply minimizing complexity of the receiver. The matched filters would generally be implemented as FIR filters, since it would be difficult to control to the and amplitude using a IIR filter design.

Figure 10:
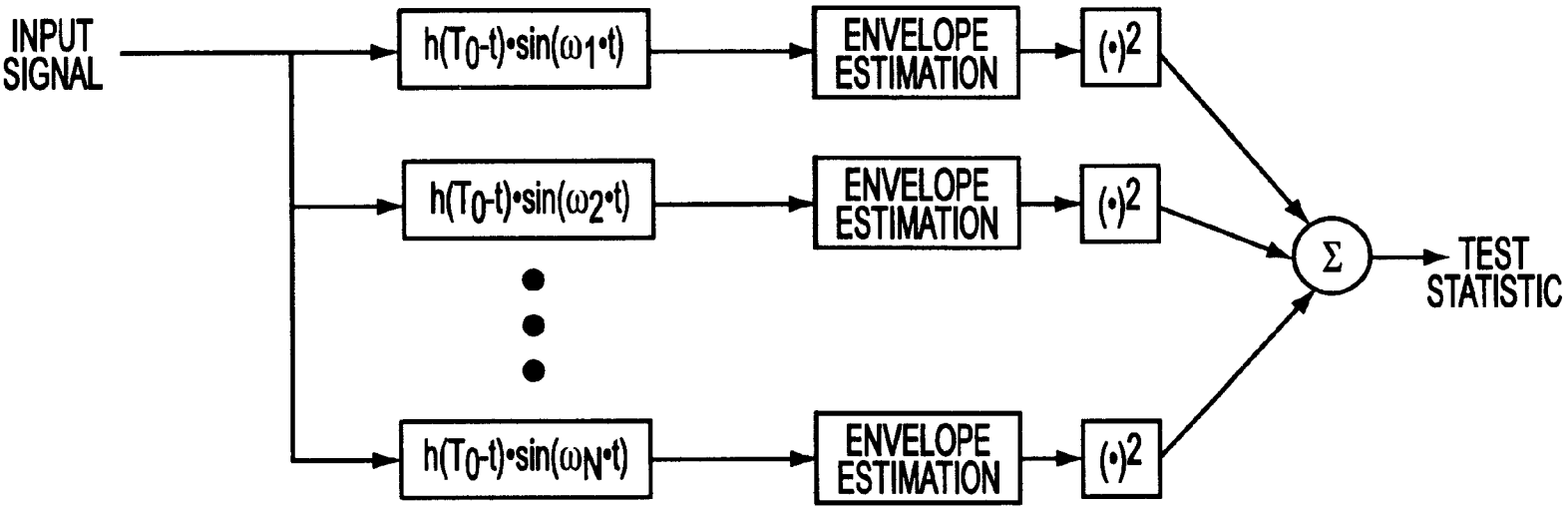
FIG. 10 is a block diagram showing implementation of the quadrature matched filter bank of the present invention using envelope detection.

Referring to FIG. 10, an implementation of the QMFB using envelope detection (estimation) is illustrated. In this implementation, only one matched filter is required. The matched filter must be within a constant phase shift. Envelope detection is used to extract the individual QMF statistics.

Figure 11:
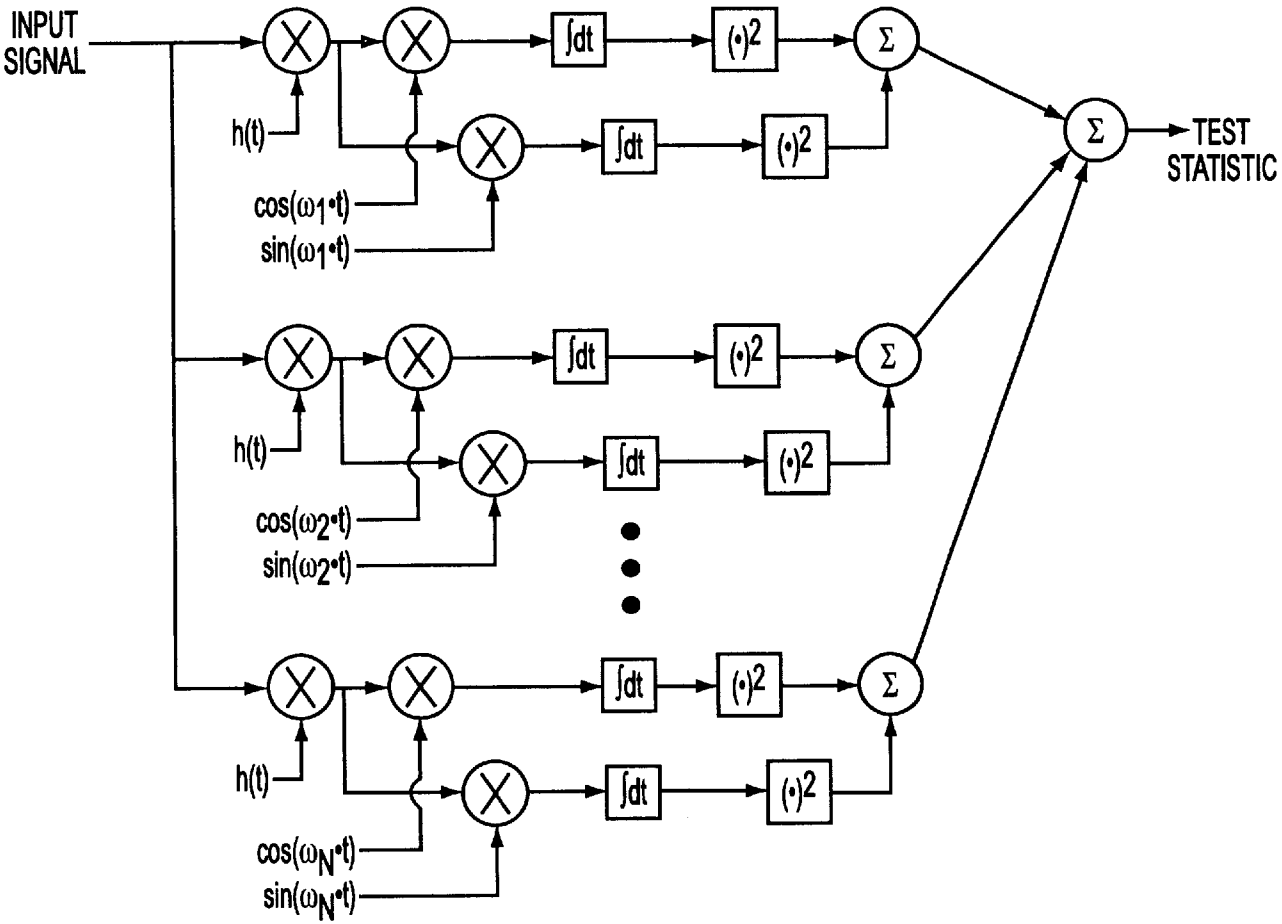
FIG. 11 is a block diagram showing implementation of the quadrature matched filter bank of the present invention as a bank of correlation receivers.

Referring to FIG. 11, an implementation as a bank of correlation receivers is illustrated. The incoming signal is modulated with the matched envelope and local oscillators, then integrated to the sampling instant $T_0$. The integrators are implemented digitally as summations, scaled by the sampling period. This implementation is typically better than the previous two because only one envelope need be stored, and in fact the envelope modulation need only be calculated once. The local oscillator modulation and integration are very simple structure to implement. This is generally much better than a bank of FIR filters.

Figure 12:
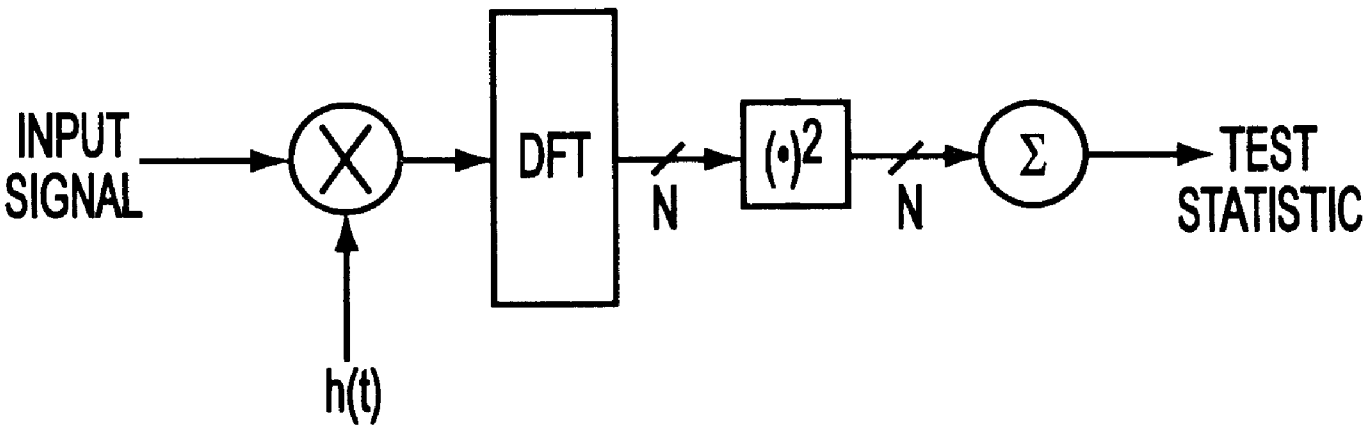
FIG. 12 is a block diagram showing implementation of the quadrature matched filter bank of the present invention as a discrete Fourier transform.

Referring to FIG. 12, an implementation as a discrete Fourier transform (DFT) is illustrated. This is a direct consequence of the structure shown in FIG. 11. When the sampling rate and frequency resolution of the local oscillators are chosen appropriately, the DFT can be implemented as a Fast Fourier transform (FFT), an extremely efficient digital implementation of the QMFB. Other variations are possible, such as Zoom FFTs when the frequency band of interest is narrower. However, the basic concept is the same.

Figure 13:
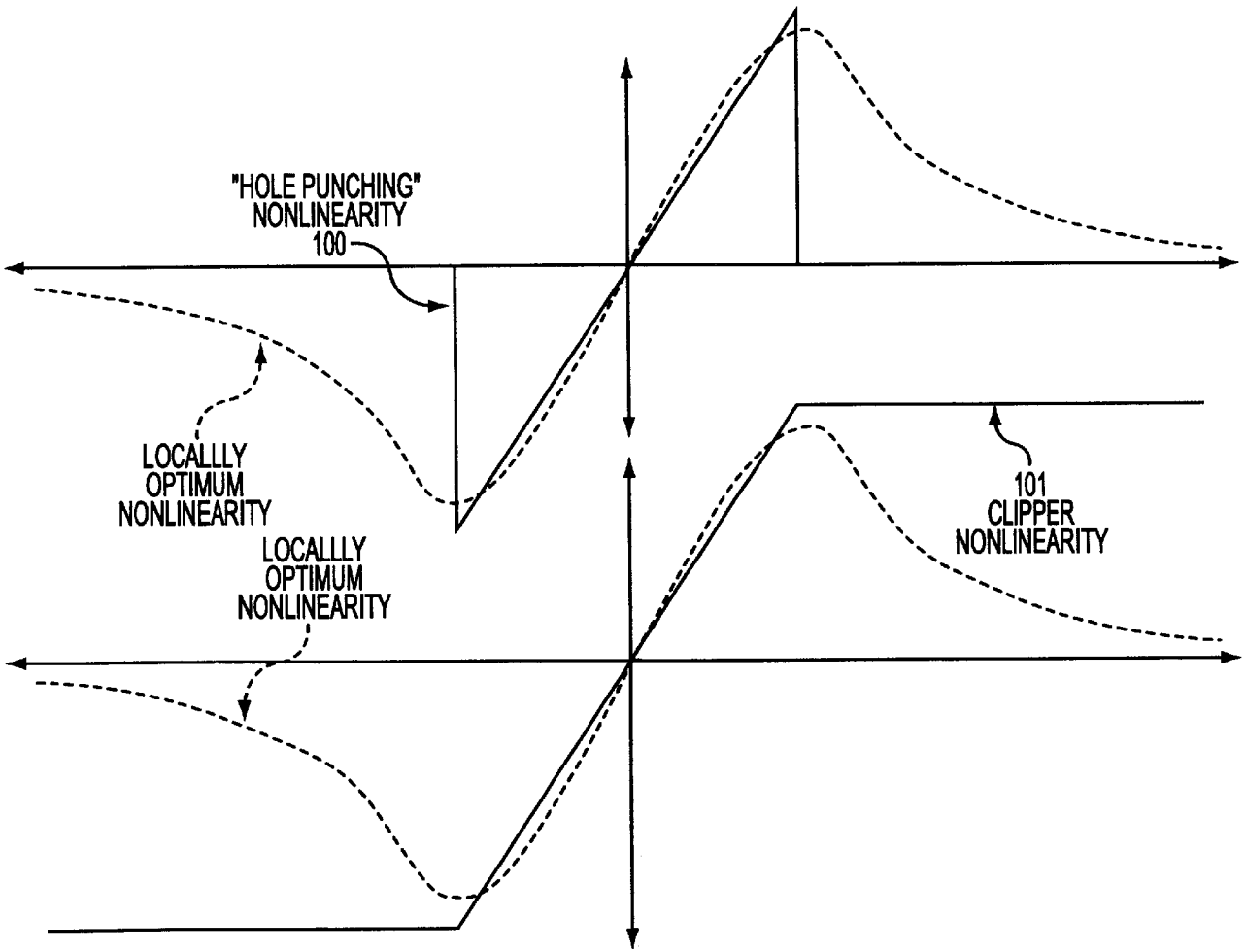
FIG. 13 is a plot showing the sub-optimum nonlinearities selected for the nonlinear filter that precede the quadrature matched filter bank of the present invention.

Referring to FIG. 13, many of the noise environments in which EAS systems are installed have some level of impulsive noise. In such environments the QMFB must be preceded by a nonlinearity. The locally optimum nonlinearity is given in terms of influence functions. However, it is not practical, or often possible since many of these waveforms cannot be generated in closed form, to use the actual optimum nonlinearity. Therefore we resort to suboptimum nonlinearities, as illustrated in FIG. 13. The "hole punch" nonlinearity 100 generally has the highest performance, but when auxiliary detection criteria such as frequency or phase estimates are implemented, this nonlinearity has adverse effects. The "clipping" nonlinearity 101 performs better. The threshold for these nonlinearities must be chosen adaptively. If the interest is in locally optimum performance, i.e., detection of weak signals, then the threshold can be chosen at some level above the RMS noise floor. However, if the interest is in detection of strong signals as well, then the threshold must be calculated adaptively from the record of data itself. For example, the RMS level of the first 100 microseconds or so of data is calculated, then the threshold is set at some level above that. In this way, strong tag signals are not excessively trimmed by the nonlinearity.

There are many other possibilities that may be implemented in the digital receiver and which are contemplated by this disclosure, including nonlinear filters, hybrid filters, or nonlinear filtering followed by linear detection filters. These types of configurations may be necessary in impulsive noise environments.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the forgoing disclosure.

What is claimed is:

1. A digital detector implemented as a quadrature matched filter bank for detecting a response signal from an electronic article surveillance tag, comprising:

a detection filter pair comprised of $h(T_0-t)\cdot\sin(\omega\cdot t)$ and $h(T_0-t)\cdot\cos(\omega\cdot t)$, wherein the envelope $h(T_0-t)$ contains preselected time and frequency domain properties according to the signal to be detected;

means for squaring the output of each of said filters; and means for summing the squared outputs of each of said filter pairs to provide a test statistic for detection of the tag signal.

2. The digital detector of claim 1 further comprising:

a plurality of said filter pairs wherein each pair is at a frequency $\omega_n$ for $1\leqq n\leqq N$, where N is selected to cover the range of uncertainty of the signal to be detected; and, means for summing each of the squared and summed results of each of said filter pairs to provide the test statistic for detection of the tag signal.

3. The digital detector of claim 2 wherein each of said filter pairs are matched to the response signal from the electronic article surveillance tag wherein the envelope $h(T_0-t)$ is the time reversed version of the signal to be detected.

4. The digital detector of claim 3 further comprising means for nonlinear filtering prior to said detection filter pair, wherein the nonlinearity of said means for nonlinear filtering is selected from a hole punch or a clipping nonlinearity.

5. A digital detector implemented as a quadrature matched filter bank with envelope estimation for detecting a signal from an electronic article surveillance tag, comprising:

a detection filter comprised of $h(T_0-t)\cdot\sin(\omega\cdot t)$ wherein the envelope $h(T_0-t)$ contains preselected time and frequency domain properties according to the signal to be detected;

means for envelope detection of the output of said filter; and, means for squaring the output of said envelope detection to provide a test statistic for detection of the tag signal.

6. The digital detector of claim 5 further comprising:

a plurality of said filters wherein each filter is at a frequency $\omega_n$ for $1\leqq n\leqq N$, where N is selected to cover the range of uncertainty of the signal to be detected; and, means for summing the output of said means for squaring for said plurality of said filters to provide the test statistic for detection of the tag signal.

7. The digital detector of claim 6 wherein each of said filters are matched to the response signal from the electronic article surveillance tag wherein the envelope $h(T_0-t)$ is the time reversed version of the signal to be detected.

8. The digital detector of claim 7 further comprising means for nonlinear filtering prior to said detection filter, wherein the nonlinearity of said means for nonlinear filtering is selected from a hole punch or a clipping nonlinearity.

9. A digital detector implemented as a bank of correlation receivers for detecting a signal from an electronic article surveillance tag, comprising:

a correlation receiver including means for mixing a received signal with an envelope h(t) and a pair of local oscillators $\cos(\omega\cdot t)$ and $\sin(\omega\cdot t)$;

means for integrating the output of said means for mixing over the sampling period $T_0$;

means for squaring the output of said integration means; and, means for summing the output of said means for squaring for each of the pair of local oscillators to provide a test statistic for detection of the tag signal.

10. The digital detector of claim 9 further comprising a plurality of said correlation receivers wherein said local oscillators $\cos(\omega_n\cdot t)$ and $\sin(\omega_n\cdot t)$ are at frequency $\omega_n$ for $1\leqq n\leqq N$, where N is selected to cover the range of uncertainty of the signal to be detected; and, means for summing the output of said plurality of correlation receivers to provide a test statistic for detection of the tag signal.

11. The digital detector of claim 10 wherein said local oscillators and said means for integration comprise a discrete Fourier transform.

12. A method, using a quadrature matched filter bank, for digitally detecting a signal from an electronic article surveillance tag, comprising:

filtering using a detection filter pair comprised of $h(T_0-t)\cdot\sin(\omega\cdot t)$ and $h(T_0-t)\cdot\cos(\omega\cdot t)$, wherein the envelope $h(T_0-t)$ is preselected to contain time and frequency domain properties according to the signal to be detected;

squaring the output of each of said filters;

summing the squared outputs of each of said filter pairs to provide a test statistic for detection of the tag signal.

13. The method of claim 12 further comprising a plurality of said filter pairs wherein each pair is at a frequency $\omega_n$ for $1\leqq n\leqq N$, where N is selected to cover the range of uncertainty of the signal to be detected and summing each of the squared and summed results of each of said filter pairs to provide the test statistic for detection of the tag signal.

14. The method of claim 13 wherein each of said filters are matched to the response signal from the electronic article surveillance tag wherein the envelope $h(T_0-t)$ is the time reversed version of the signal to be detected.

15. The method of claim 14 further comprising, prior to said detection filtering, nonlinear filtering using a nonlinearity selected from a hole punch or a clipping nonlinearity.

16. A method, using a quadrature matched filter bank with envelope estimation, for detecting a signal from an electronic article surveillance tag, comprising:

filtering using a detection filter comprised of $h(T_0-t)\cdot\sin(\omega\cdot t)$ wherein the envelope $h(T_0-t)$ is preselected to contain time and frequency domain properties according to the signal to be detected;

envelope detecting of the output of said filter;

squaring the output of said envelope detection to provide a test statistic for detection of the tag signal.

17. The method of claim 16 further comprising a plurality of said filters wherein each filter is at a frequency $\omega_n$ for $1\leqq n\leqq N$, where N is selected to cover the range of uncertainty of the signal to be detected; and, summing the squared output of said plurality of filters to provide the test statistic for detection of the tag signal.

18. The method of claim 17 wherein each of said filters are matched to the response signal from the electronic article surveillance tag wherein the envelope $h(T_0-t)$ is the time reversed version of the signal to be detected.

19. The method of claim 18 further comprising, prior to said detection filtering, nonlinear filtering using a nonlinearity selected from a hole punch or a clipping nonlinearity.

20. A method, using a bank of correlation receivers, for detecting a signal from an electronic article surveillance tag, comprising:

in a correlation receiver;

mixing a received signal with a matched envelope h(t) and a pair of local oscillators $\cos(\omega\cdot t)$ and $\sin(\omega\cdot t)$;

integrating the mixed signal over the sampling period $T_0$;

squaring the output of said integrated signal;

summing the squared output for each of the pair of local oscillators to provide a test statistic for detection of the tag signal.

21. The method of claim 20 further comprsising a plurality of said correlation receivers wherein said local oscillators $\cos(\omega_n\cdot t)$ and $\sin(\omega_n\cdot t)$ are at frequency $\omega_n$ for $1\leqq n\leqq N$, where N is selected to cover the range of uncertainty of the signal to be detected; and, summing the output of said plurality of correlation receivers to provide the test statistic for detection of the tag signal.

22. The method of claim 21 wherein said local oscillators and said integration comprise a discrete Fourier transform.

* * * * *